US010575626B2

(12) United States Patent
Dengler et al.

(10) Patent No.: US 10,575,626 B2
(45) Date of Patent: Mar. 3, 2020

(54) BRUSH HEAD ARRANGEMENTS

(71) Applicant: KONINKLIJKE PHILIPS N.V., Eindhoven (NL)

(72) Inventors: Evan Dak Wah Dengler, Seattle, WA (US); Gregory Russ Goddard, Kenmore, WA (US); Heidi Rose, Bothell, WA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 303 days.

(21) Appl. No.: 15/127,913

(22) PCT Filed: Mar. 24, 2015

(86) PCT No.: PCT/IB2015/052149
§ 371 (c)(1),
(2) Date: Sep. 21, 2016

(87) PCT Pub. No.: WO2015/145352
PCT Pub. Date: Oct. 1, 2015

(65) Prior Publication Data

US 2017/0105824 A1 Apr. 20, 2017

Related U.S. Application Data

(60) Provisional application No. 62/025,039, filed on Jul. 16, 2014, provisional application No. 62/008,762,
(Continued)

(51) Int. Cl.
*A46B 3/06* (2006.01)
*A46B 3/20* (2006.01)
(Continued)

(52) U.S. Cl.
CPC ..... *A46B 3/06* (2013.01); *A46B 3/00* (2013.01); *A46B 3/04* (2013.01); *A46B 3/20* (2013.01);
(Continued)

(58) Field of Classification Search
CPC .... A46B 3/00; A46B 3/04; A46B 3/06; A46B 3/20; A46B 7/00; A46B 7/06; A46B 9/00; A46B 9/04; A46B 9/08; A46B 9/12
(Continued)

(56) References Cited

U.S. PATENT DOCUMENTS 5,802,656 A 9/1998 Dawson et al.
8,069,524 B2 12/2011 Kraemer
(Continued)

FOREIGN PATENT DOCUMENTS

CN 1038927 A 1/1990
CN 1248151 A 3/2000
(Continued)

*Primary Examiner* — Mark Spisich

(57) ABSTRACT

A brush head having a distal end, including: an elastomeric matrix including a first surface, and a plurality of retention rings disposed in the elastomeric matrix, each of which includes a first end, a second end positioned closer to the first surface of the elastomeric matrix than the first end, an interior wall with a central longitudinal axis, and an exterior wall. The interior wall of at least a first retention ring is generally circular in shape; the interior wall of at least a second retention ring is generally non-circular in shape; the exterior wall is generally non-circular in shape; and at least one of the interior wall or the exterior wall includes a taper. The brush head can also include a plurality of bristle tufts, each of which is inserted into one of the plurality of retaining rings.

12 Claims, 6 Drawing Sheets

Related U.S. Application Data filed on Jun. 6, 2014, provisional application No. 61/974,760, filed on Apr. 3, 2014, provisional application No. 61/970,076, filed on Mar. 25, 2014, provisional application No. 61/970,011, filed on Mar. 25, 2014, provisional application No. 61/970,157, filed on Mar. 25, 2014, provisional application No. 61/970,169, filed on Mar. 25, 2014.

(51) Int. Cl.

| | |
|---|---|
| ***A46D 3/00*** | (2006.01) |
| ***A46B 9/04*** | (2006.01) |
| ***A46B 3/00*** | (2006.01) |
| ***A46B 3/04*** | (2006.01) |
| ***A46B 5/00*** | (2006.01) |
| ***A46B 9/00*** | (2006.01) |

(52) U.S. Cl.

CPC ..... *A46B 5/0029* (2013.01); *A46B 9/00* (2013.01); *A46B 9/04* (2013.01); *A46D 3/00* (2013.01); *A46B 2200/1066* (2013.01)

(58) Field of Classification Search

USPC ..... 15/167.1, 190, 191.1, 192, 193, 201

See application file for complete search history.

(56) References Cited

U.S. PATENT DOCUMENTS

| | | | | |
|---|---|---|---|---|
| 8,099,819 | B2 * | 1/2012 | Kraemer ..... | A46B 3/04 15/167.1 |
| 8,327,492 | B2 | 12/2012 | Cann | |
| 2013/0139338 | A1 | 6/2013 | Hess et al. | |

FOREIGN PATENT DOCUMENTS

| | | | |
|---|---|---|---|
| DE | 459657 | * | 5/1928 |
| DE | 1457055 | * | 9/1970 |
| DE | 10303548 | * | 8/2004 |
| DE | 102011017099 | A1 | 10/2012 |
| JP | H0490709 | A | 3/1992 |
| JP | 3131630 | U | 4/2007 |
| WO | 97/03587 | * | 2/1997 |
| WO | 9812948 | A1 | 4/1998 |
| WO | 9835584 | A1 | 8/1998 |
| WO | 98/43514 | * | 10/1998 |
| WO | 0015075 | A1 | 3/2000 |
| WO | 2004080238 | A1 | 9/2004 |

* cited by examiner

BRUSH HEAD ARRANGEMENTS

CROSS-REFERENCE TO PRIOR APPLICATIONS

This application is the U.S. National Phase application under 35 U.S.C. § 371 of International Application No. PCT/IB2015/052149, filed on Mar. 24, 2015, which claims the benefit of U.S. Provisional Patent Application Nos. 62/025,039, filed on Jul. 16, 2014, 62/008,762, filed on Jun. 6, 2014, 61/974,760, filed on Apr. 3, 2014, 61/970,076, filed on Mar. 25, 2014, 61/970,011, filed on Mar. 25, 2014, 61/970,157, filed on Mar. 25, 2014, 61/970,169, filed on Mar. 25, 2014. These applications are hereby incorporated by reference herein.

FIELD OF THE INVENTION

The present disclosure is directed generally to an improved brush head, and more particularly, to the arrangement, structure, securement, and resulting function of bristle tufts in a brush head.

BACKGROUND

Brush heads used with manual and power brushes, which have bristle tufts contained within retention or support rings seated within a brush head, are known. The retention rings serve to secure respective bristle tufts within the brush head. Typical retention rings used in manual and power brushes to hold bristle tufts in the brush head have a hollow circular shape, having both an interior and exterior non-tapered circular circumference. Each bristle tuft is inserted into the hollow interior of a different retention ring, and the bristles in the retention ring are then secured to a backing, forming the tooth brush head. In some instances, the retention rings are not firmly secured to the backing of the brush head, such that bristles are not at an optimal angle for brushing, or the ring and bristle tuft or tuft strands are loose within the brush head. As such, a related problem with such conventional retention rings is that under the dynamic conditions of motion induced by the power brush operation, for example, over time the retention rings, bristle tufts or tuft strands tend to separate from the brush head.

Accordingly, there is a need in the art for a better retention ring, improved tuft arrangement, and improved method of securing the retention rings and bristle tufts to the brush head, especially for use with power brushes.

SUMMARY OF THE INVENTION

The present disclosure is directed to an inventive arrangement, structure, securement, and resulting function of bristle tufts in a brush head. Various embodiments and implementations herein are directed to a brush head formed from an elastomeric matrix and including a variety of retention rings of differing sizes and shapes disposed therein that are tapered from bottom to top, including a variety of non-circular and non-cylindrical shapes, where an exterior wall and an interior wall of at least one of the retention rings can be of different shapes. Each retention ring includes a bristle tuft retained therein. Additional embodiments can include bristle tufts of varying lengths extending from the brush head, where the top/free portions of the bristle tufts are collectively arranged to form a non-planar functional brush surface.

Using the various embodiments and implementations herein, securement of the retention rings within the brush head and securement of the bristle tufts within the retention rings can be substantially improved by providing retention rings with non-circular exterior wall shapes. The angled wall portions of the various non-circular exterior wall shapes/geometry provide additional surface angles (as compared with cylindrical/circular shapes) to provide improved adherence/securement (i.e., improved adherence per increased contact between the exterior wall of the retention ring and the elastomeric matrix). The taper of the exterior wall also provides improved adherence between the retention ring and the elastomeric matrix. Additionally, tapering of the interior wall of the retention ring provides better securement of the bristle tuft positioned therein. These features also provide for improved and varying arrangements of bristles in the brush head. Further, using the various embodiments and implementations herein, improved and more complete teeth cleaning can be achieved based on, for example, the improved strength and flexibility of the brush head and of the bristle tuft and retention ring collective assembly, and the variety of shapes, sizes and lengths of the bristle tufts.

The improved brush head disclosed and described herein can be used with any manual or power brush device. One example of a power brush device that the improved brush head can be used with is any Sonicare® device available from Koninklijke Philips Electronics N.V. This oral care device is based upon an actuator with a reciprocating brush head including bristles to provide an effective cleaning of a user's teeth.

Generally in one aspect, a brush head for cleaning teeth is provided and includes, but is not limited to: an elastomeric matrix including a first surface; and a plurality of retention rings disposed in the elastomeric matrix, each of which includes a first end, a second end positioned closer to the first surface of the elastomeric matrix than the first end, an interior wall forming an interior space with a central longitudinal axis, and an exterior wall. The interior wall of at least a first retention ring of the plurality of retention rings is substantially circular in shape; the interior wall of at least a second retention ring of the plurality of retention rings is non-circular in shape; the exterior wall of each of the plurality of retention rings is non-circular in shape; and at least one of the interior wall or the exterior wall of each of the plurality of retention rings includes a straight taper extending from the first end to the second end in a direction toward the central longitudinal axis, where the first end is disposed in the elastomeric matrix and the first end with the straight taper is substantially the same thickness (see FIG. 6) as the second end. The brush head can also include a plurality of bristle tufts, each of which is inserted into the interior space of one of the plurality of retention rings, includes a plurality of bristle strands, has a proximal end and a free end, and is retained at its proximal end by the formation of a head portion of the bristle tuft adjacent to the exterior of the first end of the one of the plurality of retention rings; and a neck, a distal platen portion of which is connected to and at least partially embedded in the proximal end of the elastomeric matrix, wherein the neck is formed of a material with a higher elastic modulus value than the elastomeric matrix.

In accordance with an embodiment, the non-circular shape of the interior wall of at least a second retention ring or of the exterior wall is generally pentagonal.

In accordance with an embodiment, the elastomeric matrix is made from a thermoplastic elastomer.

In accordance with an embodiment, at least one of the plurality of retention rings is made from a thermoplastic polymer.

In accordance with an embodiment, the thermoplastic polymer is polypropylene.

In accordance with an embodiment, the plurality of retention rings are formed of a material with a higher elastic modulus value than the elastomeric matrix.

In accordance with an embodiment, a first bristle tuft and a second bristle tuft extend a further distance from the first surface than a third bristle tuft positioned between the first and second bristle tufts.

In accordance with an embodiment, a first bristle tuft and a second bristle tuft extend a shorter distance from the first surface than a third bristle tuft positioned between the first and second bristle tufts.

In accordance with an embodiment, a first bristle tuft of the plurality of bristle tufts is positioned and retained within a first retention ring and further includes a head portion at the proximal end of the first bristle tuft, the head portion being positioned adjacent to the first end of the first retention ring and having an area larger than the area of a plane of the interior space surrounded and created by the first end of the first retention ring.

In accordance with an embodiment, the plurality of retention rings include at least two retention rings with two different interior space sizes, respectively.

In accordance with an embodiment, at least one of the plurality of retention rings are connected by a webbing link to at least one other retention ring of the plurality of retention rings.

Generally in another aspect, a method for manufacturing a brush head assembly, the method including, but not limited to, the step of: providing a plurality of polypropylene bristle tuft retention rings, each of which includes a first end, a second end positioned closer to the first surface of the elastomeric matrix than the first end, and an interior wall forming an interior space with a central longitudinal axis, and an exterior wall. At least one of the interior wall or the exterior wall of each of the plurality of retention rings includes a straight taper extending from the first end to the second end in a direction toward the central longitudinal axis; and the plurality of bristle tuft retention rings are at least partially interconnected by a network of webbing links. The method can further include the steps of inserting a respective nylon bristle tuft into each of the bristle tuft retention rings; applying heat to each bristle tuft proximal end at a temperature sufficient to at least partially melt the bristle tuft proximal end and create a proximal head portion adjacent to the exterior of the first end of each of the plurality of retention rings; positioning a platen portion of a neck of the brush head in relation to the proximal head portions, wherein the positioning of the platen portion of the neck defines a space in relation to the proximal head portions for injection of a thermoplastic elastomer; and injecting through a gate in the neck the thermoplastic elastomer into the space to create an elastomeric matrix that at least partially encompasses the platen and the proximal head portions.

In accordance with an embodiment, the exterior wall of each of the plurality of retention rings is generally non-circular in shape.

In accordance with an embodiment, the interior wall of at least a first retention ring of the plurality of retention rings is generally circular in shape; and the interior wall of at least a second retention ring of the plurality of retention rings is generally non-circular in shape.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of an improved brush head for dental cleaning. More generally, Applicants have recognized and appreciated that it would be beneficial to provide a brush head formed from of an elastomeric matrix and including a variety of retention rings of differing sizes and shapes disposed therein for improved adherence per increased contact between an exterior wall of a particular retention ring and the brush head, and between an interior wall of the retention ring and a bristle tuft positioned therein. Additionally, customizing the shape of the retention ring can allow for additional bristle movement, and thus enhanced cleaning ability. As such, Applicants recognized and appreciated that it would be beneficial to provide a brush head and a bristle tuft and retention ring collective assembly with improved strength and flexibility, and bristle tufts with a variety of shapes and sizes (due in part to the differing sizes and shapes of the retention rings, including a variety of non-circular and non-cylindrical shapes), and lengths for improved and more complete teeth cleaning.

Additionally, in another related arrangement, retention rings can be connected through a separate webbing or matrix of webbing links to further stiffen a elastomeric matrix (in which the retention rings are seated) to improve retention ring and bristle tuft retention within a elastomeric matrix and to increase stiffness and/or create certain areas of flexibility in the elastomeric matrix, as well as to simplify manufacturing over the use of individual retention rings.

A particular goal of utilization of the embodiments of the present disclosure is the ability of the embodiments of the improved brush head to provide improved adherence between the exterior wall of the retention ring and the brush head and between the interior wall of the retention ring and the bristle tuft positioned therein, and improved arrangement of bristles in the brush head. Another goal is to provide improved and more complete teeth cleaning.

In view of the foregoing, various embodiments and implementations are directed to an apparatus in which a brush head is formed from an elastomeric matrix and includes a variety of retention rings of differing sizes and shapes disposed therein, where each retention ring includes a bristle tuft retained therein, and where an exterior wall and an interior wall of at least one of the retention rings can be different shapes. In these embodiments, the brush head can also include bristle tufts of varying lengths extending from the brush head, where the top portions of the bristle tufts are collectively arranged to form a non-planar functional brush surface.

Brush Head Assembly

Figure 1A:
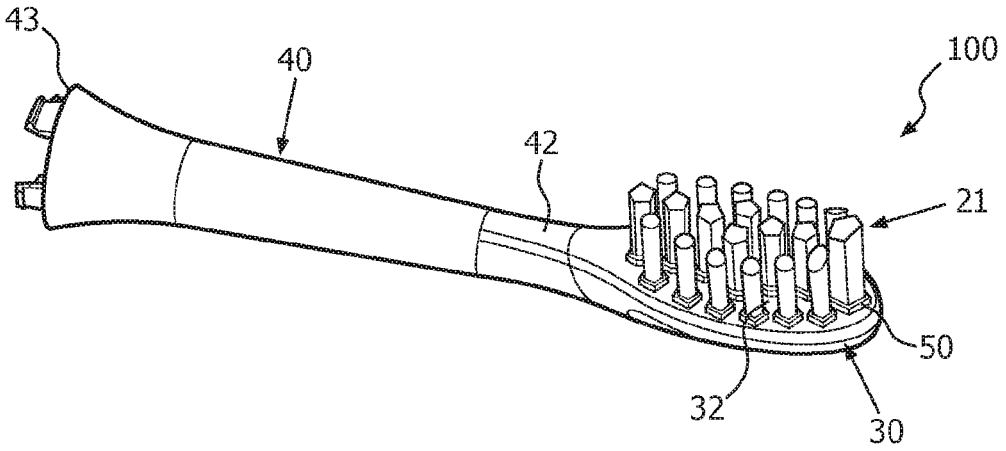
FIG. 1A is a perspective top view schematic representation of a brush head assembly in accordance with an embodiment.

Referring to FIG. 1A, in one embodiment, a perspective assembled top view schematic representation of a brush head assembly 100 is provided. More particularly, the brush head assembly 100 can include, but is not limited to, an elastomeric matrix 30 including a first surface 32 that is preferably substantially planar (but is not required to be planar). A plurality of individual bristle tufts 21, each of which includes a plurality of bristle strands, are retained within plurality of individual retention rings 50 disposed in the elastomeric matrix 30. The plurality of individual bristle tufts 21 are shown extending from the first surface 32 of the elastomeric matrix 30. A distal portion 42, called a platen, of a neck 40 is also at least partially enclosed in and connected to the elastomeric matrix 30.

Figure 1B:
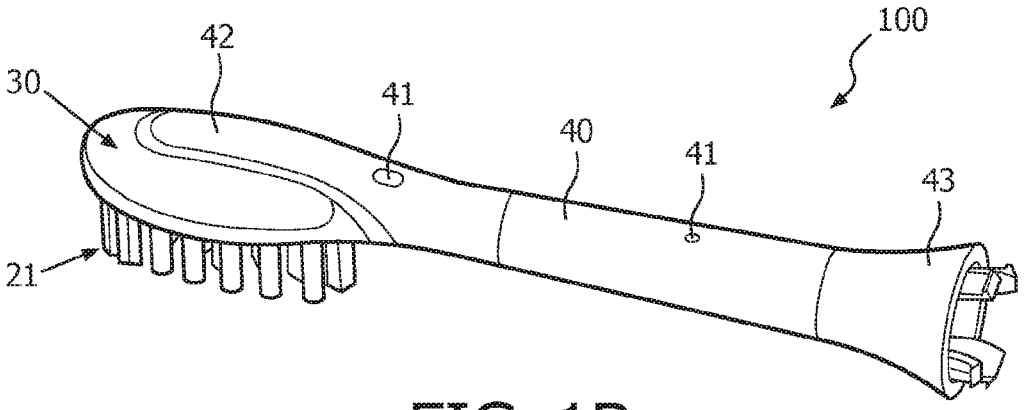
FIG. 1B is a perspective bottom/back side view schematic representation of a brush head assembly of FIG. 1A in accordance with an embodiment.

Referring to FIG. 1B, in one embodiment, a perspective assembled bottom/back side view schematic representation of a brush head assembly 100 is provided. The distal platen portion 42 of the neck 40 is shown connected to and at least partially embedded in the elastomeric matrix 30, opposite the proximal portion 43 of the neck 40. The proximal portion 43 of the neck 40 can be coupled to any manual brush shaft, or, more preferably, to any actuator and drive shaft (not shown) made or suitable for powered oral care devices now known or to be developed. At least one gate 41 is shown on the back side of the neck 40. The gate 41 is used for the injection molding of the elastomeric matrix 30, described further below.

According to an embodiment, the elastomeric matrix 30 is preferably made from a flexible thermoplastic elastomer (TPE), and the retention rings 50 are preferably made from thermoplastic polymer such as polypropylene. Each of the neck 40 and the retention rings are preferably made from a material with a higher elastic modulus value than the elastomeric matrix 30, although the neck and the retention rings can be made of different materials from each other.

Figure 2A:
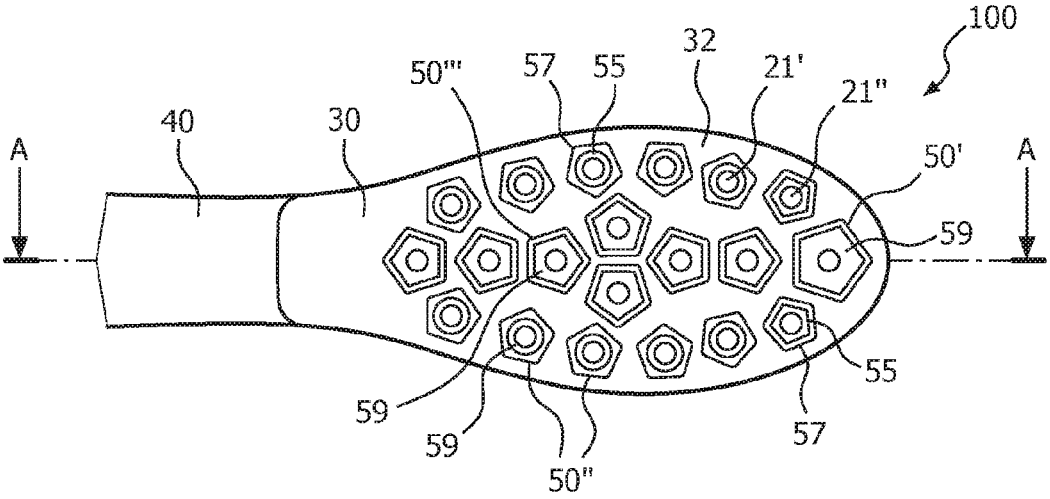
FIG. 2A is a top view schematic representation of a brush head assembly in accordance with an embodiment.

Referring to FIG. 2A, in one embodiment, a top view schematic representation of a brush head assembly 100 is provided. An elastomeric matrix 30 having a distal end 36 thereof is shown. A plurality of retention rings 50, each having an interior space 59 and disposed in the elastomeric matrix 30 are also shown. More particularly, an improved arrangement of separate individual bristle tufts (e.g., 21'-21''', etc.) are shown retained within separate individual retention rings (e.g., 50'-50''', etc.), respectively, which extend out from the first surface 32 of the elastomeric matrix 30. The particular number and arrangement (spacing and placement) of the retention rings 50 and bristle tufts 21 in the elastomeric matrix 30 can vary, and can be a function of a number of variables including the type of cleaning desired, the specifics of teeth and gums (structure, location, and surface configuration) to be accessed and cleaned, and the desired flexibility or stiffness of portions of the brush head 100. Additionally, the sizes and shapes of the respective interior spaces 59 of the individual retention rings can vary. For example, the interior space of retention ring 50' positioned at the distal end 36 of the brush head can be larger than the other interior spaces of any of the other individual retention rings (as shown in FIG. 2A), thus, forming the largest bristle tuft as measured by area at its free end per the largest number of bristle strands contained within retention ring 50'. Further, in one preferable embodiment, the interior spaces 59 of the retention rings (50'') along the outer perimeter of the of the brush head are shown to be smaller than the interior spaces 59 of the retention rings in the interior of the brush head (e.g., 50'''). As such, the number of bristle strands that fit within the interior spaces of each of the retention rings can vary and be a function of the size of the interior space of each individual retention ring.

Figure 2B:
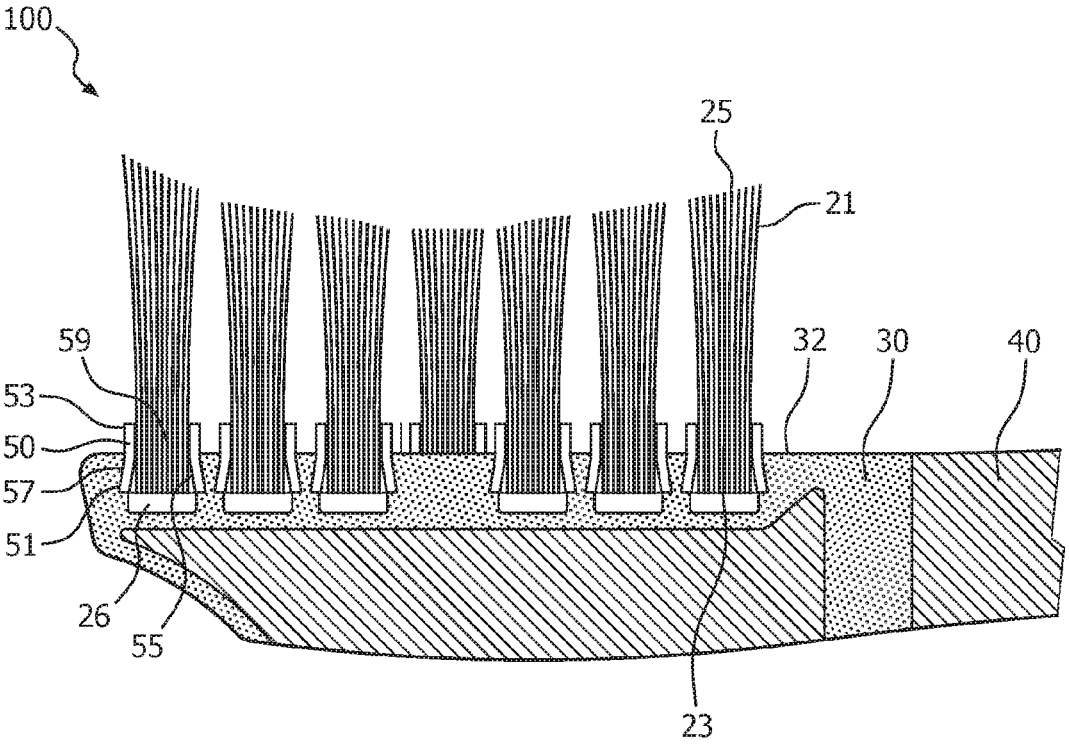
FIG. 2B is a sectional view schematic representation along A-A of brush head assembly shown in FIG. 2A in accordance with an embodiment.

Referring to FIG. 2B, in one embodiment, a sectional view schematic representation along A-A of brush head assembly 100 shown in FIG. 2A is provided. This sectional view shows several individual retention rings 50 disposed in the elastomeric matrix 30. Each individual retention ring includes first end 51, second end 53 (which is positioned closer to the first surface 32 of the elastomeric matrix than the first end 51), the interior wall 55 forming an interior space 59 (each of which is filled by a bristle tuft), and an exterior wall 57. Additionally, each of the plurality of bristle tufts includes a proximal end 23 and a free end 25. Each individual bristle tuft shown in FIG. 2B includes a head portion 26 at its proximal end 23. The head portion 26 is positioned adjacent to the first end 51 of the retaining ring, and has an area larger than the first end of the retention ring within which the bristle tuft is retained. This head portion 26 assists with retaining the bristle tuft within the retention ring.

Figure 2C:
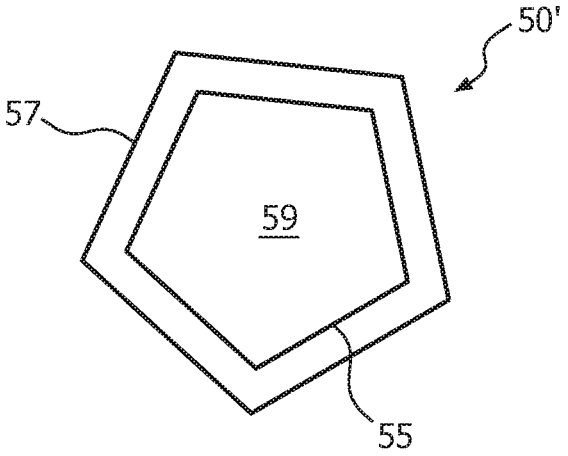
FIG. 2C is a top view schematic representations of a particular retention ring of the brush head assembly shown in FIG. 2A in accordance with an embodiment.
Figure 2D:
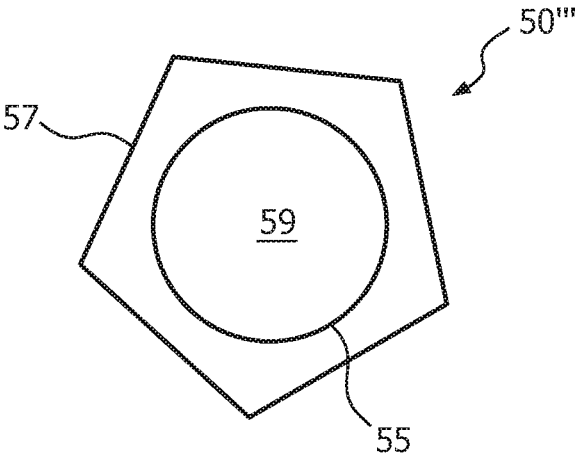
FIG. 2D is a top view schematic representations of another particular retention ring of the brush head assembly shown in FIG. 2A in accordance with an embodiment.

Referring to FIGS. 2C-2D, in one embodiment, top view schematic representations of certain retention rings of the of brush head assembly 100 are shown. More specifically, FIG. 2C shows retention ring 50' with an interior space 59 and with a central longitudinal axis 111 (shown in FIG. 6). The geometrical shape of each of the exterior wall 57 and the interior wall 55 of retention ring 50' is non-circular, and, in particular, pentagonal in shape. FIG. 2D shows retention ring 50''' with an interior space 59 with a central longitudinal axis 111 (shown in FIG. 6). Similar to retention ring 50', the shape of the exterior wall 57 of retention ring 50''' is non-circular, and, in particular, pentagonal in shape. However, the interior wall 55 of the retention ring 50 ''' is circular (i.e., the interior wall 55 and exterior wall 57 of retention ring 50''' are different shapes). An embodiment contemplates arrangements of individual retention rings in an elastomeric matrix 30 with any combination of interior wall 55 and exterior wall 57 shape combinations (e.g., circular and non-circular; or two different non-circular shapes, respectively), and a variety of any combination of interior space 59 area sizes.

The shape and area size of the interior space 59 of a retention ring, and thus the bristle tuft retained therein, are dictated by the shape and size of the interior wall. For example, an interior wall 55 shape that is non-circular will assist in the formation of a non-circular bristle tuft, and an interior wall 55 shape that is generally circular will assist in the formation of a generally circular/cylindrical bristle tuft. See, for example, the shape of bristle tuft 21" (non-circular) vs. the shape of bristle tuft 21' (generally circular/round/cylindrical) in FIG. 2A. These shapes and sizes can be chosen based on the need to obtain an optimal bristle arrangement for improved brushing.

Figure 3A:
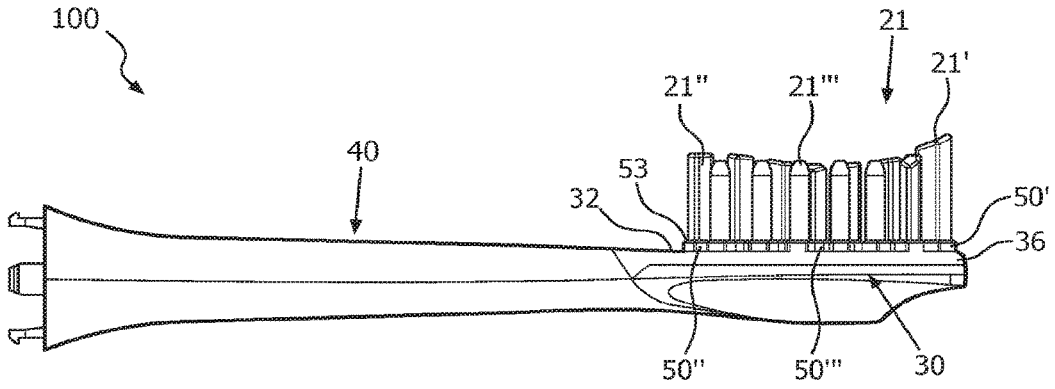
FIG. 3A is a side view schematic representation of a brush head assembly in accordance with an embodiment.
Figure 3B:
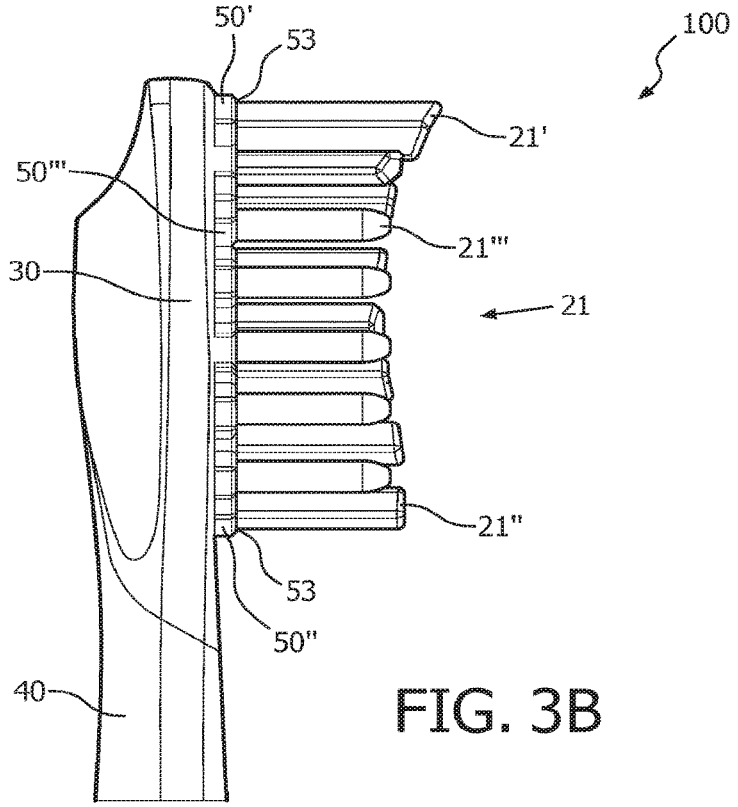
FIG. 3B is an opposite side view schematic representation (as compared to FIG. 3A) of a brush head assembly in accordance with an embodiment.

Referring to FIGS. 3A-3B, in one embodiment, opposite side view schematic representations of a brush head assembly 100 are provided. More specifically, FIG. 3A shows a side-profile of a non-planar "lounge-shaped" arrangement of bristle tufts 21 (as seen from the distal end 36 of the brush head). As shown, bristle tuft 21' positioned adjacent to the distal end 36 extends a further distance from the first surface 32 than any of the other bristle tufts. FIG. 3B shows example lengths of bristle tuft 21' (10.20 mm), bristle tuft 21" (8.40 mm) and bristle tuft 21''' (7.70 mm) as measured from the respective second ends 53 of each of the respective retention rings 50', 50" and 50'''.

Figure 4:
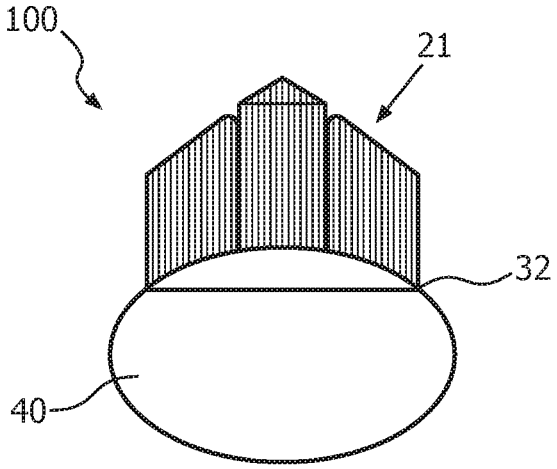
FIG. 4 is a proximal view schematic representation of a brush head assembly in accordance with an embodiment.

Referring to FIG. 4, in one embodiment, a proximal view schematic representation of a brush head assembly 100 is provided. This view shows a radial trim profile arrangement of bristle tufts 21, where the bristle tufts positioned adjacent to the outer perimeter of the brush head extend a shorter distance from the first surface 32 than the bristle tufts positioned in the central portion of the brush head.

Figure 5:
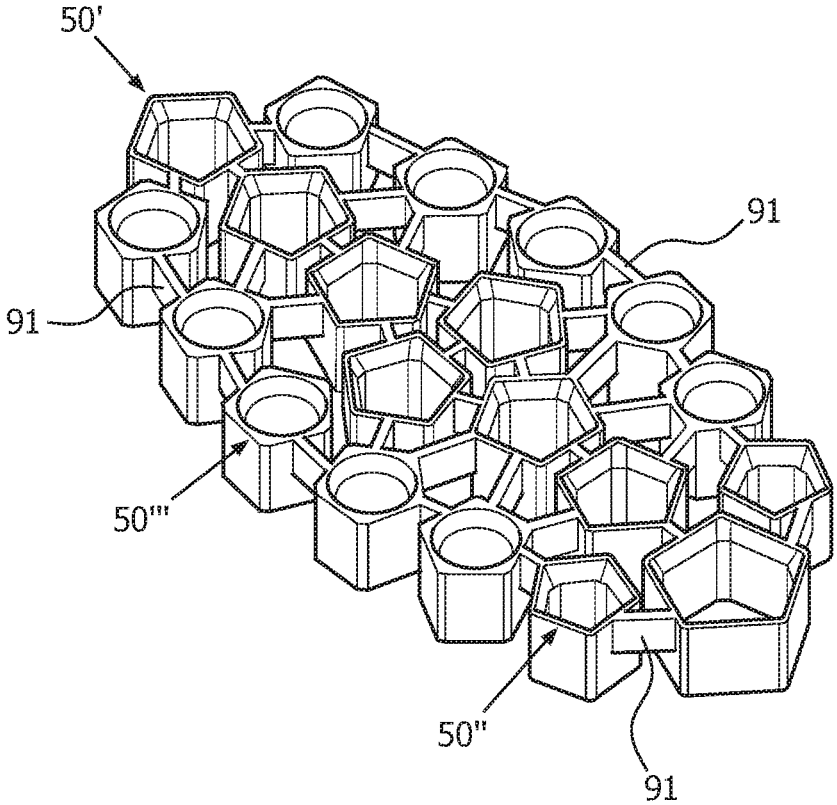
FIG. 5 is a top perspective view schematic representation showing webbing links connecting retention rings of different sizes and shapes in accordance with an embodiment.

According to an embodiment, at least some of the plurality of retention rings can be connected by a webbing or matrix of webbing links as shown in FIG. 5. In one embodiment, a top perspective view schematic representation of webbing links 91 connecting a certain example arrangement of retention rings—50'-50''—is provided. More specifically, this embodiment shows links 91 connecting each of the retention rings as also shown in and previously discussed with respect to FIG. 2A. The webbing links can serve to further stiffen an elastomeric matrix 30 (in which the retention rings are seated) and to improve retention ring and bristle tuft retention within the elastomeric matrix 30. While the arrangement shown in FIG. 5 shows all of the retention rings connected by webbing, it can be appreciated that as few as a total of two retention rings can be connected by webbing links. The webbing links and retention rings can be formed of a material different from the elastomeric matrix, and preferably is a material that is stiffer (material that includes a higher elastic modulus value) than the elastomeric matrix 30.

Figure 6:
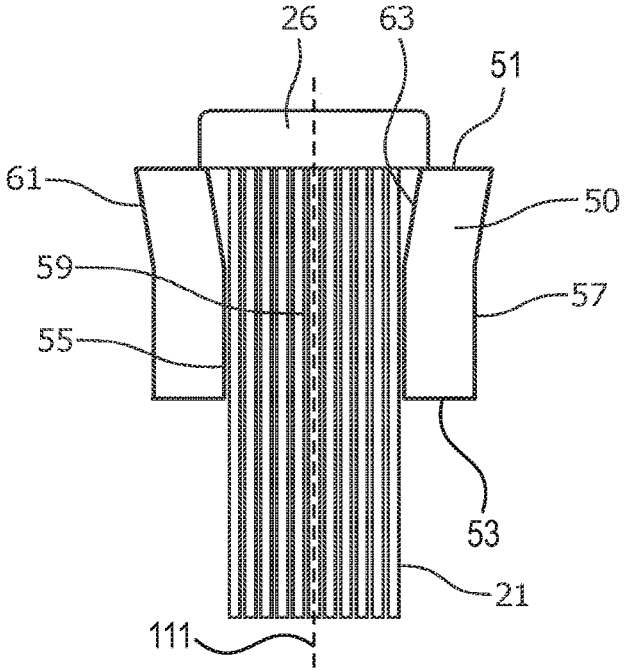
FIG. 6 is a side view schematic representation of a retention ring with a bristle tuft retained therein and including an exterior wall and interior wall, each of which includes a taper, in accordance with an embodiment.

Referring to FIG. 6, in one embodiment, a side view schematic representation of an example of one of the plurality of retention rings 50 including an interior space 59 with one of the plurality of bristle tufts 21 retained therein, and including an exterior wall 57 and interior wall 55, each of which includes a taper, is shown. More particularly, retention ring 50 is shown with an exterior wall taper 61 and an interior wall taper 63, which differ from each other. For example, the interior wall taper can be more pronounced starting from the first end 51 of the retention ring 50 to about between a quarter of the length of the retention ring and the middle of the retention ring 50. FIG. 6 also shows a head portion 26 at the proximal end of the bristle tuft 21, where the head portion 26 is positioned outside of and adjacent to the first end 51 of retention ring 50 and has an area larger than the first end 51 of the retaining ring. Many other embodiments and combinations of the exterior wall taper 61 and the interior wall taper 63 are possible. For example, the "top" portion (starting at the first end 51 of the retention ring 50) of each of the interior wall taper 63 and the exterior wall taper 61 can be wider to accommodate the head portion 26.

Methods of Brush Head Assembly Manufacture

In manufacturing the brush head assembly, a plurality of retention rings 50 are provided, each of which includes an interior wall 55 forming an interior space 59 and an exterior wall 57. Retention rings 50 can be any of the shapes, sizes, and/or configurations described or otherwise envisioned herein. For example, the plurality of retention rings 50 can be the same size and shape, or multiple different sizes and shapes (including an interior wall and an exterior wall of the same or different shapes, including non-circular shapes), and can include an interior wall and/or an exterior wall with a taper. In one embodiment two or more of the plurality of retention rings 50 are connected or at least partially interconnected by a webbing or network of webbing links 91 to improve retention ring and bristle tuft retention within the brush head, although a webbing link 91 is not necessary, and a plurality of individual retention rings 50 can be used. According to an alternative embodiment, for example, the plurality of retention rings 50 can be held in place by a tuft ring, or by some other support mechanism. The tuft ring or other support mechanism can be removed prior to one or more downstream steps, or can form part of the completed brush head assembly.

A bristle tuft 21 (which comprises a plurality of bristle strands) is inserted into each of the plurality of retention rings 50. Each of the bristle tufts 21 includes a proximal end 23 and a free end 25, with the proximal end being inserted into the retention ring.

Heat is applied to the proximal end 23 of the plurality of bristle tufts 21 to create a proximal end head portion 26. Proximal end head portion 26 is the melted end of the bristle tuft 21. For example, the heat can be supplied by a heat source that comes into direct physical contact with the proximal end 23 of the bristle tufts. In addition the heat can be supplied by heated air or any of a variety of other heat sources. Note that in some embodiments, the heating of the proximal end 23 of the plurality of bristle tufts 21 can be done in conjunction with the step of applying the elastomeric matrix 30, below, depending on the chemical composition, and therefore the melting point, of the bristle tufts 21, and elastomeric matrix 30.

According to an embodiment, the heat applied is sufficiently hot enough and/or sufficiently long enough to also melt, at least partially, the retention ring 50 to the bristle tuft. This would further prevent individual bristles within bristle tuft 21 from escaping or moving around inside the retention ring.

The brush head neck 40 is then positioned to put the platen 42 in the proper location in relation to the retaining rings 50 with the bristle tufts 21 inserted, and the webbing links 91. For example, platen 42 is positioned just above head portion 26 of the bristle tufts 21 in the retaining rings 50. Platen 42 can be properly positioned using a mold, for example, or other positioning mechanism. This creates a space into which an elastomeric material can be injected.

An elastomeric material is molded into the space over the platen 42, the head portion 26 of the bristle tufts, and the retaining rings 50, as well as the webbing links 91 if they are present. The molded elastomeric material forms an elastomeric matrix 30. According to an embodiment, elastomeric matrix 30 is preferably made from a flexible thermoplastic elastomer, while the retaining rings are preferably made from thermoplastic polymer such as polypropylene. According to this embodiment, each of the platen 42 and the retaining rings 50 is made from a material with a higher elastic modulus than the elastomeric matrix 30. According to an embodiment (not shown), neck 40 and platen 42 of the brush head are inserted into a mold and block the egress of the elastomeric material from the mold cavity. As shown in FIG. 1B, neck 40 comprises one or more gates 41 which allows the molten elastomeric material to be injected into the cavity of the mold.

According to another embodiment, the retaining rings 50 have a higher melting temperature than bristle tufts 21. For example, if nylon is used for the bristle tufts, the melting temperature is approximately 213° C. A higher temperature material is then used for the retaining rings 50, such as polyether ether ketone, which has a melting temperature of approximately 343° C. Many other polymers are possible for the bristle tufts and the retaining rings, as long as the melting temperature disparity is properly configured. According to this embodiment, the bristle tufts are first properly positioned, and the proximal ends of the bristles are melted to form head portion 26. Then, the retaining rings 50 are positioned or formed, such as molding, around the positioned bristle tufts 21. For example, the retaining rings can be molded, inserted, or otherwise formed around the positioned bristle tufts. This allows the bristles to fuse and bond directly to the retaining rings, for example.

At an optional step of the method, not shown, after the brush head has been completely assembled, the free end 25 of one or more of the inserted bristle tufts 21 can be trimmed in order to provide a particular free end profile.

Other embodiments of brush head assembly 100 are possible, including other configurations bristle tufts 21, retention rings 50, and/or elastomeric matrix 30.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A brush head having a distal end, comprising:

an elastomeric matrix comprising a first surface;

a plurality of retention rings disposed in the elastomeric matrix, each of which comprises a first end, a second end positioned closer to the first surface of the elastomeric matrix than the first end, an interior wall forming an interior space with a central longitudinal axis, and an exterior wall, wherein:

the interior wall of at least a first retention ring of the plurality of retention rings is substantially circular in shape;

the interior wall of at least a second retention ring of the plurality of retention rings is non-circular in shape;

the exterior wall of each of the plurality of retention rings is non-circular in shape;

the interior wall or the exterior wall of each of the plurality of retention rings comprises a straight taper extending from the first end to the second end in a direction toward the central longitudinal axis, where the first end is disposed in the elastomeric matrix and wherein the ring wall thickness of the first end with straight taper is substantially the same as the ring wall thickness of the second end;

a plurality of bristle tufts, each of which is inserted into the interior space of one of the plurality of retention rings, comprises a plurality of bristle strands, has a proximal end and a free end, and is retained at its proximal end by the formation of a head portion of the bristle tuft adjacent to the exterior of the first end of the one of the plurality of retention rings; and a neck, a distal platen portion of which is connected to and at least partially embedded in the proximal end of the elastomeric matrix, wherein the neck is formed of a material with a higher elastic modulus value than the elastomeric matrix.

2. The brush head of claim 1, wherein the non-circular shape of the interior wall of the at least a second retention ring or of the exterior wall is substantially pentagonal.

3. The brush head of claim 1, wherein the elastomeric matrix is made from a thermoplastic elastomer.

4. The brush head of claim 3, wherein at least one of the plurality of retention rings is made from a thermoplastic polymer.

5. The brush head of claim 4, wherein the thermoplastic polymer is polypropylene.

6. The brush head of claim 1, wherein the plurality of retention rings are formed of a material with a higher elastic modulus value than the elastomeric matrix.

7. The brush head of claim 1, wherein the first surface is substantially planar, and at least two of the plurality of bristle tufts extend from the first surface at different distances away from the first surface.

8. The brush head of claim 7, wherein a first bristle tuft and a second bristle tuft extend a further distance from the first surface than a third bristle tuft positioned between the first and second bristle tufts.

9. The brush head of claim 7, wherein a first bristle tuft and a second bristle tuft extend a shorter distance from the first surface than a third bristle tuft positioned between the first and second bristle tufts.

10. The brush head of claim 1, wherein a first bristle tuft of the plurality of bristle tufts is positioned and retained within a first retention ring and further comprises the head portion at the proximal end of the first bristle tuft, the head portion being positioned adjacent to the first end of the first retention ring and having an area larger than the area of a plane of the interior space surrounded and created by the first end of the first retention ring.

11. The brush head of claim 1, wherein the plurality of retention rings comprise at least two retention rings with two different interior space sizes, respectively.

12. The brush head of claim 1, wherein at least one of the plurality of retention rings are connected by a webbing link to at least one other retention ring of the plurality of retention rings.

* * * * *